US009814320B2

(12) United States Patent
Pratt

(10) Patent No.: US 9,814,320 B2
(45) Date of Patent: Nov. 14, 2017

(54) MULTIFUNCTIONAL FURNITURE SYSTEM

(71) Applicant: Folashade Annie Evelyn Pratt, Rosemount, MN (US)

(72) Inventor: Folashade Annie Evelyn Pratt, Rosemount, MN (US)

( * ) Notice: Subject to any disclaimer, the term of this patent is extended or adjusted under 35 U.S.C. 154(b) by 0 days.

(21) Appl. No.: 15/185,556

(22) Filed: Jun. 17, 2016

(65) Prior Publication Data

US 2017/0095089 A1 Apr. 6, 2017

Related U.S. Application Data

(60) Provisional application No. 62/235,670, filed on Oct. 1, 2015.

(51) Int. Cl.

| | |
|---|---|
| ***A47C 13/00*** | (2006.01) |
| ***A47D 1/04*** | (2006.01) |
| ***A47C 7/00*** | (2006.01) |
| ***A47C 4/02*** | (2006.01) |
| ***A47C 7/42*** | (2006.01) |
| ***A47B 85/04*** | (2006.01) |
| ***A47B 87/02*** | (2006.01) |
| *A47B 47/00* | (2006.01) |

(52) U.S. Cl.

CPC ..... *A47C 13/005* (2013.01); *A47B 85/04* (2013.01); *A47B 87/0276* (2013.01); *A47C 4/021* (2013.01); *A47C 7/42* (2013.01); *A47B 47/0091* (2013.01); *A47B 2220/02* (2013.01)

(58) Field of Classification Search

CPC ..... A47C 13/005; A47C 4/021; A47C 7/42; A47B 87/0207; A47B 85/04; A47B 87/0276; A47B 2220/02; A47B 47/0091

USPC ..... 297/1, 3, 108, 109, 440.1, 440.13, 297/440.15, 440.16

See application file for complete search history.

(56) References Cited

U.S. PATENT DOCUMENTS

| | | | | |
|---|---|---|---|---|
| D148,350 S | | 3/1874 | Cole | |
| 2,036,157 A | * | 3/1936 | Mansberger | A47C 3/029 297/3 X |
| 2,414,998 A | | 1/1947 | Barnum | |
| 2,440,979 A | * | 5/1948 | Schneider | A47D 1/04 297/3 X |
| 2,554,617 A | | 5/1951 | Dion | |

(Continued)

FOREIGN PATENT DOCUMENTS

| | | | | |
|---|---|---|---|---|
| DE | 19631683 A1 | * | 2/1998 | A47C 4/021 |

OTHER PUBLICATIONS

Llstol.com, "LLSTOL," Apr. 8, 2016, http://www.llstol.com/ , 14 pages.

*Primary Examiner* — Rodney B White
(74) *Attorney, Agent, or Firm* — Fish & Richardson P.C.

(57) ABSTRACT

A furniture system can include a base and a top. The base has a first surface defining a first slot and a second surface defining a second slot. The top has an end that is sized and configured to be inserted in the first slot and in the second slot. The furniture system forms a chair of a first configuration with the top forming a chair back and the first surface forming a first chair seat when the end of the top is inserted in the first slot. The furniture system forms a chair of a second configuration with the top forming the chair back and the second surface forming a second chair seat when the end of the top is inserted in the second slot. The furniture system can also be configured as various types of tables.

20 Claims, 12 Drawing Sheets

(56) References Cited

U.S. PATENT DOCUMENTS 2,602,491 A * 7/1952 Rakatansky ..... A47C 1/028 297/3
2,667,208 A 1/1954 Whalen
2,728,374 A 12/1955 Whalen
2,776,700 A * 1/1957 Potter ..... A47C 4/021 297/3 X
3,371,963 A * 3/1968 Weller ..... A47C 5/005 297/451.8
3,402,962 A * 9/1968 Ellis ..... A47D 1/004 297/3 X
D218,420 S 8/1970 Weidner
3,556,586 A * 1/1971 Beardmore ..... A47B 83/02 297/3 X
3,592,506 A * 7/1971 Breslow ..... A47D 1/04 297/1
3,787,909 A 1/1974 Johnson
3,788,700 A * 1/1974 Wartes ..... A47B 3/00 297/440.13 X
4,181,352 A * 1/1980 Bumpus ..... A47D 1/04 297/3 X
4,205,876 A * 6/1980 Cetina ..... A47D 1/00 297/3 X
4,241,949 A * 12/1980 Parker ..... A47C 3/029 297/3 X
4,593,950 A * 6/1986 Infanti ..... A47C 3/029 297/3 X
4,735,455 A * 4/1988 Cuniberti ..... A47C 1/028 297/1
4,763,580 A * 8/1988 Garland ..... A47D 1/004 297/1 X
4,968,091 A * 11/1990 Mariol ..... A47D 1/103 297/3
5,230,523 A * 7/1993 Wilhelm ..... B62B 7/12 297/3 X
5,415,454 A * 5/1995 Fu-Tsung ..... A47D 1/006 297/3 X
6,000,750 A * 12/1999 Rossman ..... A47D 1/004 297/3 X
6,109,695 A * 8/2000 Kahwaji ..... A47C 4/021 297/440.13 X
6,155,641 A * 12/2000 Frost ..... A47D 1/04 297/3 X
6,367,874 B2 4/2002 Casini
6,773,063 B2 8/2004 Eerkens
6,796,614 B1 9/2004 Paul
7,020,911 B2 4/2006 Oldham
7,481,496 B2 1/2009 Smith
7,547,073 B2 6/2009 White, III et al.
7,744,161 B2 * 6/2010 Berg ..... A47C 4/021 297/440.13
8,408,640 B1 4/2013 Sawhney
9,609,954 B1 * 4/2017 Hamburg ..... A47C 7/62
2006/0192414 A1 * 8/2006 Berkes ..... A47D 1/08 297/3
2006/0214476 A1 * 9/2006 Rojas ..... A47C 4/30 297/3
2008/0236452 A1 10/2008 Pratt et al.
2012/0043788 A1 * 2/2012 Alink ..... A47C 1/029 297/1
2012/0119629 A1 5/2012 Nelson et al.
2012/0246823 A1 10/2012 Conley

* cited by examiner

MULTIFUNCTIONAL FURNITURE SYSTEM

CROSS-REFERENCE TO RELATED APPLICATION

The entire contents of U.S. Provisional Application Ser. No. 62/235,670, entitled "Multifunctional Furniture," filed on Oct. 1, 2015, are herein incorporated by reference.

TECHNICAL FIELD

This invention relates to furniture, and more particularly to furniture that can perform multiple functions.

BACKGROUND

Furniture is commonly used by people to make a room or living space fit for one or more particular uses. Furniture includes items such as tables and chairs. Chairs are commonly used for supporting people sitting on the chairs. Tables are commonly used to support objects placed on the tables, such as food, drink, and other objects.

Some rooms or other living spaces can have a limited amount of space. Bulky and awkward furniture items can provide challenges in such living space, which can reduce the comfort and function of the living space. This can be especially true when the living space is filled with numerous furniture items.

SUMMARY

Some embodiments of a furniture system can include one or more of the features and functions disclosed herein. Some embodiments can include two pieces capable of being combined in different ways to form one or more configurations of chairs and tables. Some embodiments can include a chair back that can be inserted into two differently-angled slots in a base to allow the chair back to have different angles of recline. Some embodiments can be modular and combined in different ways to perform different functions. In some of such embodiments, the furniture system can be a relatively simple and convenient system that is relatively easy to assemble and disassemble. Some embodiments can be relatively small in occupied spaces and suitable for use in smaller homes.

In one aspect, a furniture system can include a base and a top. The base has a first surface defining a first slot and a second surface defining a second slot. The top has an end sized and configured to be inserted in the first slot and in the second slot. The furniture system forms a chair of a first configuration with the top forming a chair back and the first surface forming a first chair seat when the end of the top is inserted in the first slot. The furniture system forms a chair of a second configuration with the top forming the chair back and the second surface forming a second chair seat when the end of the top is inserted in the second slot.

Implementations can include any, all, or none of the following features. The first slot has a first angle and the second slot has a second angle different than the first angle such that the chair back is reclined at a greater angle in the second configuration than in the first configuration. The first surface is substantially parallel to the second surface. A third surface extends from the first surface to the second surface and is angled with respect to the first surface at an obtuse angle and with respect to the second surface at an acute angle, a fourth surface extends from the first surface to the second surface and is angled with respect to the first surface at an acute angle and with respect to the second surface at an obtuse angle, and the third surface is substantially parallel to the fourth surface. The first slot is positioned nearer the third surface than the fourth surface, the first slot is angled with respect to both the first and third surfaces at acute angles, the second slot is positioned nearer the fourth surface than the third surface, and the second slot is angled with respect to both the second and fourth surfaces at acute angles. The base has a substantially parallelepiped outer shape and is substantially tubular so as to define a passage through the base. The passage is defined between the first surface, the second surface, a third surface, and a fourth surface. The base defines a first indentation positioned along a first corner of the base and a second indentation positioned along a second corner of the base opposite the first corner. The top includes an extension sized to fit in and substantially fill each of the first and second indentations. The end is a first end, the top includes a second end, and the extension extends from the second end with a substantially trapezoidal cross section. The furniture system forms a table of a third configuration with the top forming a table top when the top is positioned on the base with the extension positioned in one of the first and second indentations. The second indentation is sized and positioned to receive at least part of a user's heel when the furniture system forms the chair of the first configuration, and the first indentation is sized and positioned to receive at least part of the user's heel when the furniture system forms the chair of the second configuration. The first indentation is positioned proximate the first slot and the second indentation is positioned proximate the second slot. The furniture system forms a table of a third configuration with the top forming a first table top when the top is positioned on the base with the end not inserted in either of the first and second slots. The furniture system forms a table of a fourth configuration when the base is rotated such that the first and second surfaces are side surfaces and the top is removed from the base. The base defines second and third table tops when forming the table of the fourth configuration, a first indentation is positioned along a first corner of the base and a second indentation positioned along a second corner of the base opposite the first corner, and the third table top is positioned along a surface of the first indentation. An elongated table includes a plurality of the furniture systems positioned adjacent to one another, with each of the furniture systems in the third configuration. A bench includes a plurality of the furniture systems set adjacent to one another with one or more of the furniture systems oriented as the chair of the first configuration and one or more of the furniture systems oriented as the chair of the second configuration. A shelving system includes a plurality of the furniture systems stacked so as to allow access to passageways defined by inner surfaces of the bases of the furniture systems.

In another aspect, a method of assembling the furniture system includes positioning the base on a floor with the second surface adjacent the floor and inserting the end of the top into the first slot to form the chair of the first configuration. The method further includes removing the end of the top from the first slot, rotating the base 180 degrees and positioning the base on the floor with the first surface adjacent the floor, inserting the end of the top into the second slot to form the chair of the second configuration, and removing the end of the top from the second slot.

Implementations can include any, all, or none of the following features. The method can further include positioning the top on the base with the end of the top not inserted in either of the first and second slots to form a table in a third configuration.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1B:
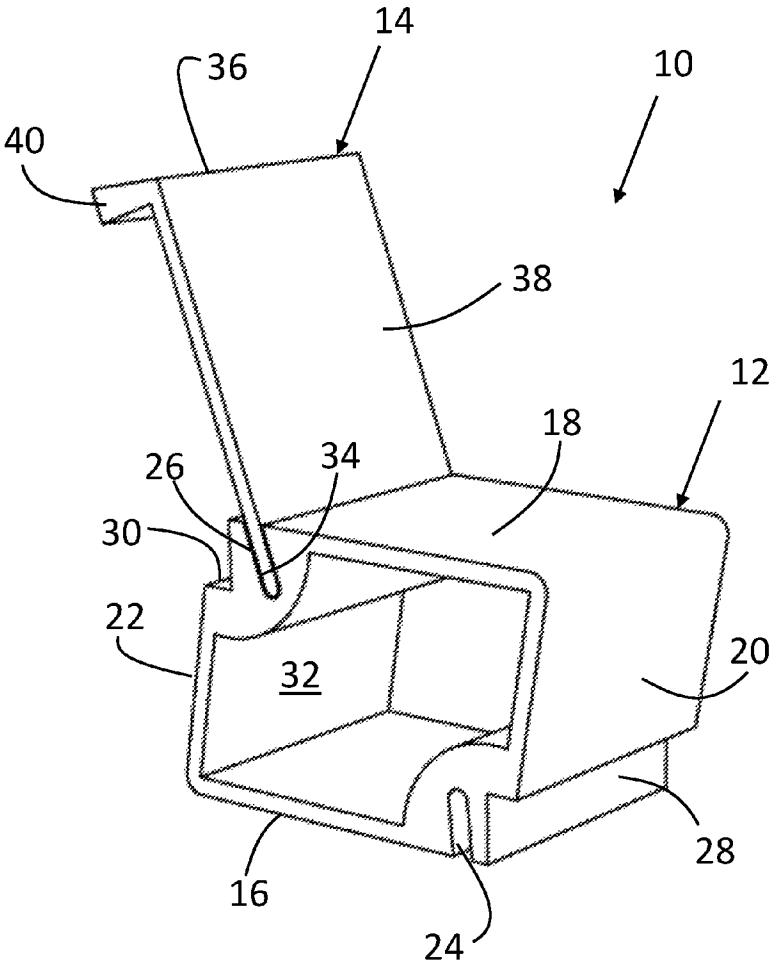
FIG. 1B is a perspective view of the furniture system forming a chair in a second configuration.
Figure 1A:
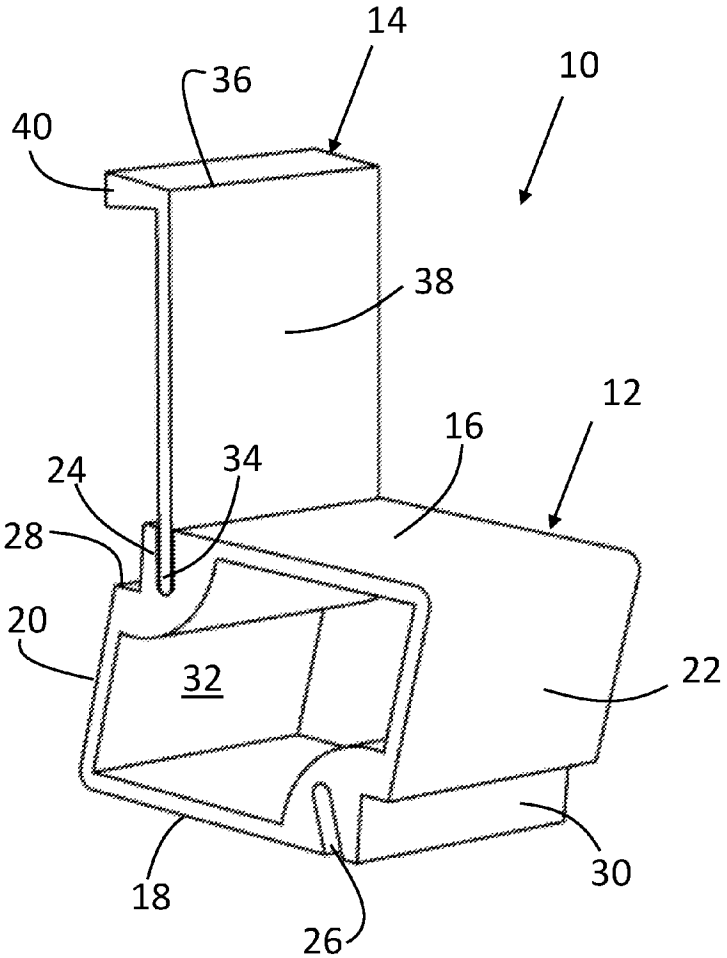
FIG. 1A is a perspective view of a furniture system forming a chair in a first configuration.
Figure 2B:
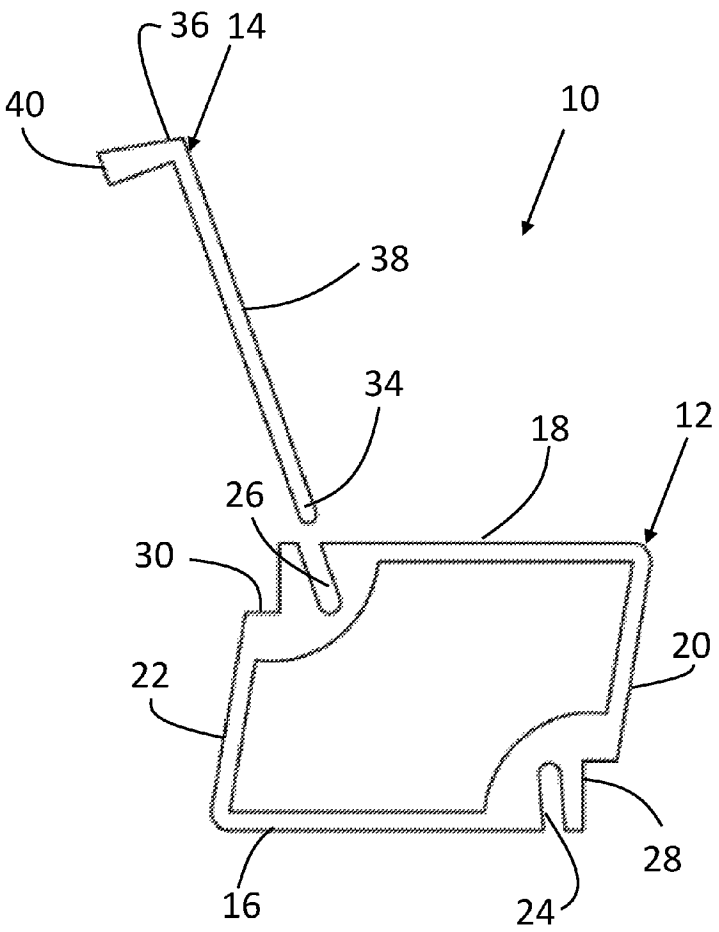
FIG. 2B is an exploded side view of the furniture system forming the chair in the second configuration.
Figure 2A:
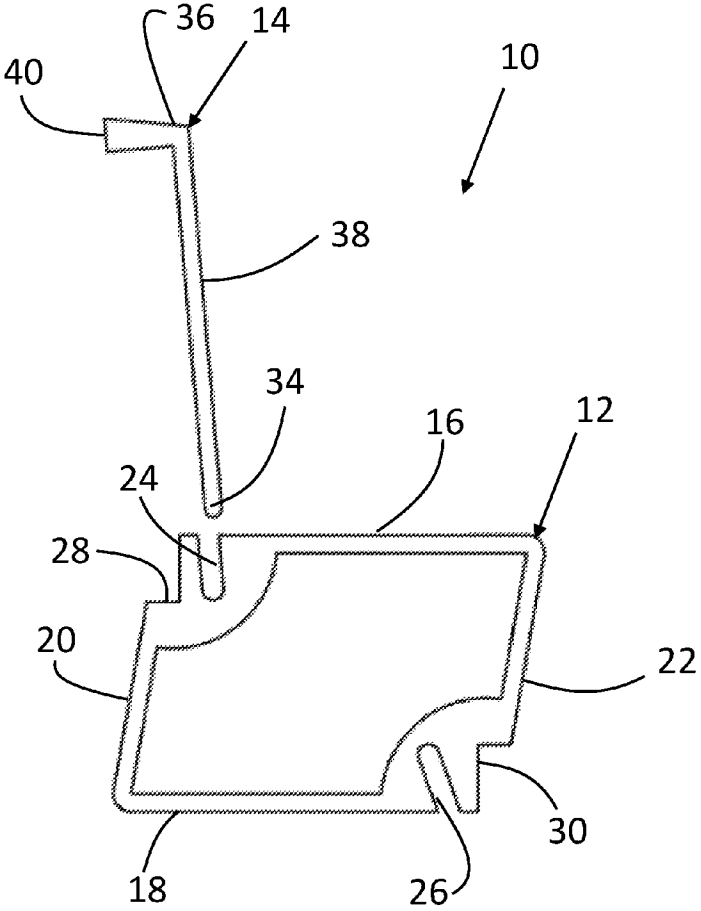
FIG. 2A is an exploded side view of the furniture system forming the chair in the first configuration.

FIG. 1A is a perspective view of a furniture system 10 forming a chair in a first configuration. FIG. 1B is a perspective view of the furniture system 10 forming a chair in a second configuration. FIG. 2A is an exploded side view of the furniture system 10 forming the chair in the first configuration. FIG. 2B is an exploded side view of the furniture system 10 forming the chair in the second configuration. The furniture system 10 includes a base 12 and a top 14 which can be combined in different configurations to form a chair (such as shown in FIGS. 1A, 1B, 2A, and 2B) or a table. The base 12, the top 14, and some of the various configurations of chairs and tables that can be formed from the base 12 and the top 14 are described herein.

The base 12 includes surfaces 16, 18, 20, and 22. The surface 16 is positioned opposite of the surface 18 and the surface 20 is positioned opposite of the surface 22. The surfaces 16, 18, 20, and 22 can be outer surfaces forming a perimeter of the base 12. In some embodiments, the base 12 can have a substantially parallelepiped shape, with the surface 16 being parallel to the surface 18 and the surface 20 being parallel to the surface 22. The surface 20 extends from the surface 16 to the surface 18 and is angled with respect to the surface 16 at an obtuse angle and with respect to the surface 18 at an acute angle. The surface 22 extends from the surface 16 to the surface 18 and is angled with respect to the surface 16 at an acute angle and with respect to the surface 18 at an obtuse angle.

The base 12 can have one or more slots 24 and 26 (also referred to as slits) shaped and sized for receiving and supporting the top 12. The slot 24 can be defined by and extend into the surface 16. The slot 24 can extend into the surface 16 at a position nearer the surface 20 than the surface 22 such that there is a greater amount of space between the slot 24 and the surface 22 than between the slot 24 and the surface 20. This configuration allows for the surface 16 to form a chair seat between the slot 24 and the surface 22 when the top 14 is inserted in the slot 24, such as shown in FIGS. 1A and 2A. The slot 24 can be angled with respect to one or both of the surfaces 16 and 20 at acute angles.

The slot 26 can be defined by and extend into the surface 18. The slot 26 can extend into the surface 18 at a position nearer the surface 22 than the surface 20 such that there is a greater amount of space between the slot 26 and the surface 20 than between the slot 26 and the surface 22. This configuration allows for the surface 18 to form a chair seat between the slot 26 and the surface 20 when the top 14 is inserted in the slot 26, such as shown in FIGS. 1B and 2B. The slot 26 can be angled with respect to one or both of the surfaces 18 and 22 at acute angles.

In some embodiments, the slot 24 can have an angle that is different from that of slot 26. This can allow the top 14 to function as a chair back and be reclined at a greater angle when inserted in the slot 26 (as shown in FIGS. 1B and 2B) than when inserted in the slot 24 (as shown in FIGS. 1A and 2A). For example, in some embodiments the slot 24 can be angled with respect to the surface 16 at an angle of about 85 degrees, allowing for the top 14 to be reclined at an angle of about 95 degrees when inserted in the slot 26. In some embodiments, the slot 26 can be angled with respect to the surface 18 at an angle of about 70 degrees, allowing for the top 14 to be reclined at an angle of about 110 degrees when inserted in the slot 26.

In other embodiments the slot 24 can be angled with respect to the surface 16 at another angle between 80 and 90 degrees, allowing for the top 14 to be reclined at an angle between 100 and 90 degrees when inserted in the slot 26. The slot 26 can be angled with respect to the surface 18 at an angle between 50 and 80 degrees, allowing for the top 14 to be reclined at an angle between 130 and 100 degrees when inserted in the slot 26. In still other embodiments, the slots 24 and 26 can have other angles suitable for the application.

In some embodiments, the base 12 can have one or more indentations 28 and 30. The indentations 28 and 30 can be sized and positioned to provide space for heels of a user when the furniture system 10 is used as a chair. For example, the indentation 30 can be positioned at an intersection of the surfaces 18 and 22 such that the indentation is at the bottom-front of the base 12 when the furniture system 10 is being used as a chair in the first configuration with the top 14 inserted in the slot 24. Similarly, the indentation 28 can be positioned at an intersection of the surfaces 16 and 20 such that the indentation is at the bottom-front of the base 12 when the furniture system 10 is being used as a chair in the second configuration with the top 14 inserted in the slot 26. Accordingly, the indentations 28 and 30 can be positioned at opposite corners of the base 12. In embodiments where the surfaces 20 and 22 are angled, the indentations 28 and 30 can be positioned at those corners having obtuse angles (such as illustrated in FIGS. 2A and 2B), which can provide for a relatively ergonomic and comfortable seat for a user. In some embodiments, the indentation 28 can be positioned proximate the slot 24 and the indentation 30 can be positioned proximate the slot 26.

In some embodiments, the base 12 can be substantially tubular, with an inner surface 32 defining a passageway through the base 12. This can allow the base 12 to have a substantially continuous cross-section across a width of the base 12. This can be illustrated, for example, in FIGS. 2A and 2B where the base 12 appears substantially as a ring having the shape of a parallelogram. One or both of the slots 24 and 26 can extend substantially the entire width of the base 12 from one side to the other side. One or both of the indentations 28 and 30 can extend substantially the entire width of the base 12 from one side to the other side. In other embodiments, one or more of the slots 24 and 26 and the indentations 28 and 30 can extend across only a portion of the width of the base 12.

The top 14 can have a first end 34, a second end 36, and a platform 38 extending between the first end 34 and the second end 36. An extension 40 can extend from the top 14 at the second end 36. The extension 40 can have a substantially trapezoidal cross-sectional shape, with one side extending substantially perpendicular with respect to the platform 38 and another side extending at an angle with respect to the platform 38. The first end 34 can be relatively narrow as compared to the second end 36. For example, the platform 38 portion of the top 14 can be relatively thin and flat, with the same or similar thickness as that of the first end 34. The first end 34 can be sized to be inserted in the slots 24 and 26 such that the top 14 forms a back rest when the furniture system 10 is in a chair configuration. The platform 38 can extend upward from the first end 34 when the first end 34 is positioned in one of the slots 24 and 26, and second end 36 can form a top edge of the top 14 with the extension 40 extending backwards from the second end 36. In some embodiments the platform 38 of the top 14 can be substantially planar. In other embodiments, the platform 38 can have one or more curved surfaces.

Figure 3:
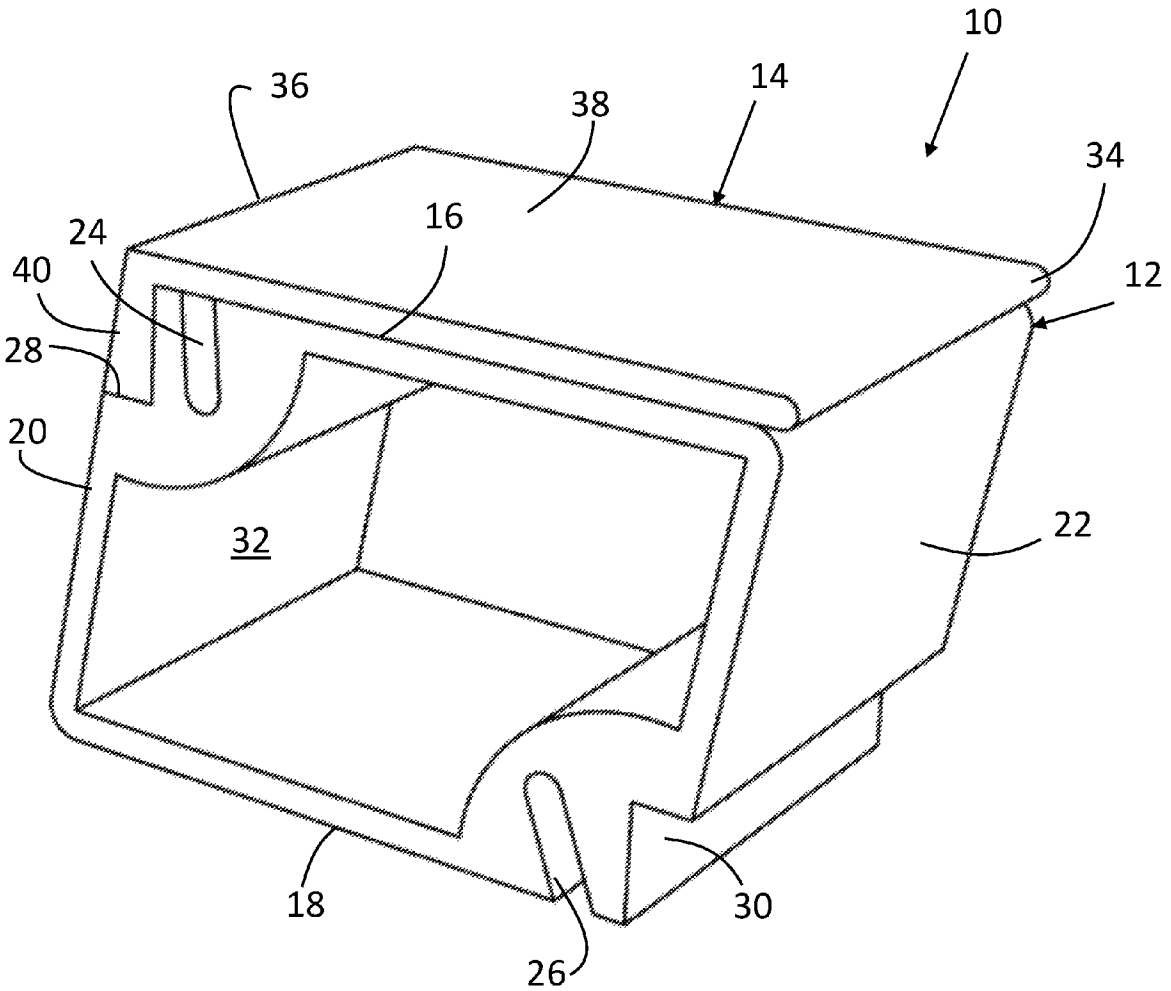
FIG. 3 is a perspective view of the furniture system forming a table in a third configuration.

FIG. 3 is a perspective view of the furniture system 10 forming a table in a third configuration in which the top 14 is not inserted in either of the slots 24 or 26, but rather, has been laid down on the base 12. As shown in FIG. 3, to platform 38 of the top 14 is positioned on the surface 16 of the base 12, with both the platform 38 and the surface 16 extending substantially horizontally. The platform 38 of the top 14 can form a substantially flat table-top when in the third configuration, suitable for supporting objects placed thereon.

The extension 40 of the top 14 is positioned to extend downward into the indentation 28. The extension 40 can be sized and shaped to substantially fill the indentation 28. Accordingly, the extension 40 is effectively keyed to fit in the indentation 28 and align the platform 38 in a suitable position on the base 12.

In some embodiments, the base 12 can be flipped with the surface 16 positioned on the floor and the top 14 positioned on the surface 18 of the base 12. In that configuration, the extension 40 of the top 14 can be positioned to extend downward into the indentation 30. The indentations 28 and 30 can have substantially the same shape such that the extension 40 is sized and shaped to substantially fill both indentations 28 and 30, depending on which side of the base 12 is facing upwards. Accordingly, the extension 40 is effectively keyed to fit in the indentation 30 and align the platform 38 in a suitable position on the base 12 when the surface 18 is facing upwards. This configuration allows the furniture system 10 to be converted between a chair and a table without having to flip the base 12 regardless of which chair configuration (e.g. the first chair configuration shown in FIGS. 1A and 2A and the second chair configuration shown in FIGS. 1B and 2B) is being used.

Figure 4B:
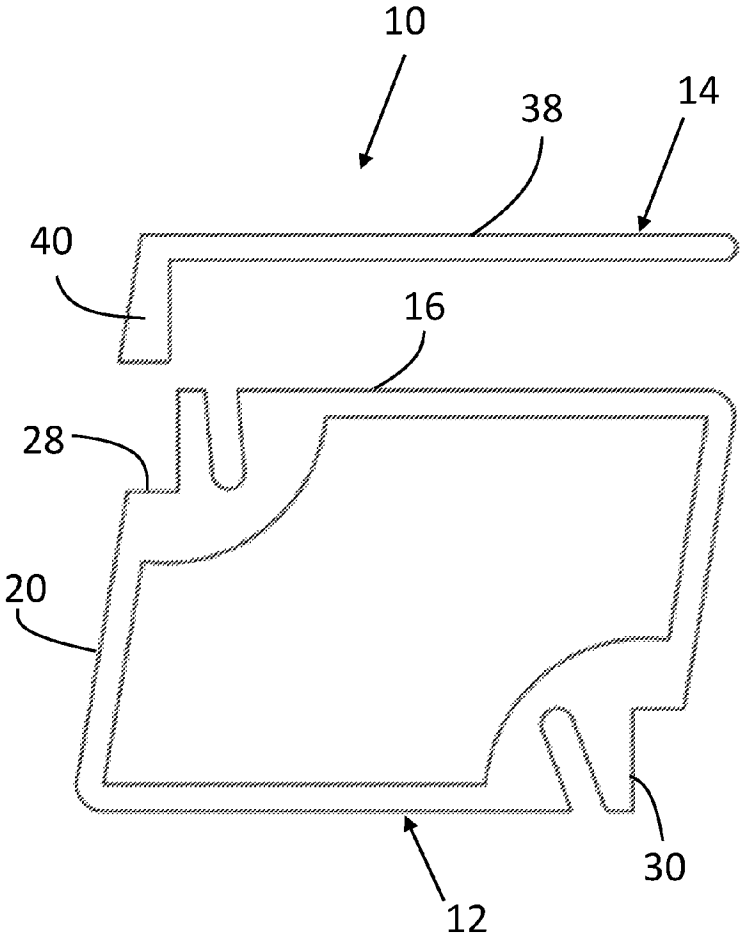
FIG. 4B is an exploded side view of the furniture system forming the table in the third configuration.
Figure 4A:
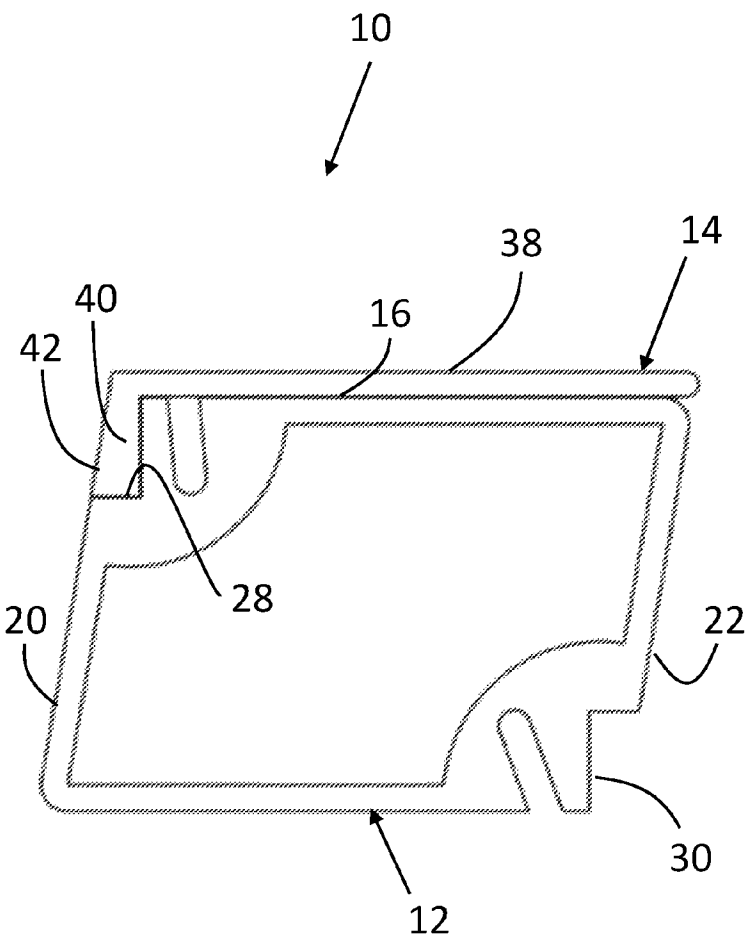
FIG. 4A is a side view of the furniture system forming the table in the third configuration.

FIG. 4A is a side view of the furniture system 10 forming the table in the third configuration. FIG. 4B is an exploded side view of the furniture system 10 forming the table in the third configuration (i.e., with the top 14 lifted off the base 12). FIG. 4A illustrates the furniture system 10 with the top 14 placed on the base 12, and the extension 40 positioned in the indentation 28. The extension 40 can have an outer surface 42 that is angled so as to be substantially flush with the surface 20 when the extension 40 is positioned in the indentation 28. The outer surface 42 of the extension 40 can also be substantially flush with the surface 22 when the extension 40 is positioned in the indentation 30. FIG. 4B illustrates the furniture system 10 prior to placing the top 14 on the base 12 to show the base 12 and the top 14 separated.

Figure 5B:
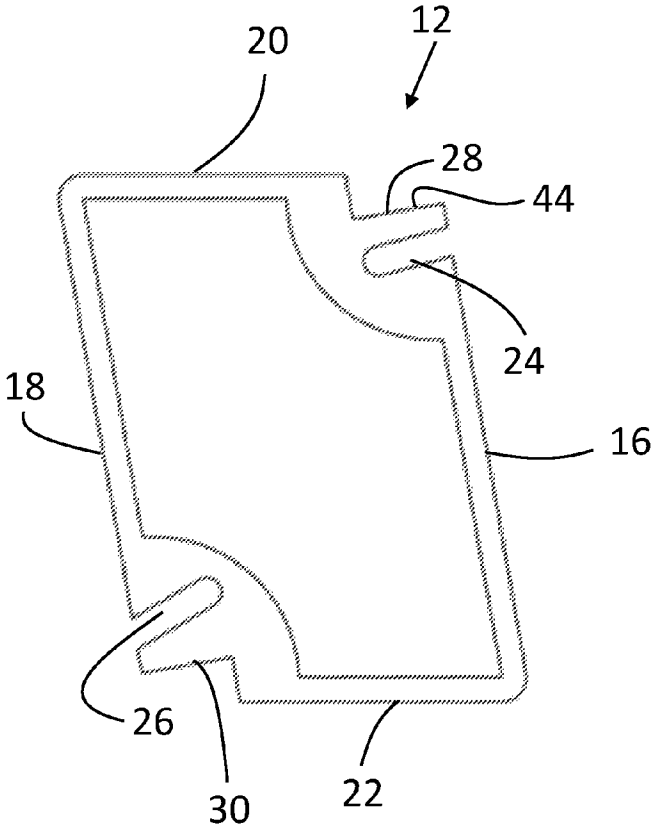
FIG. 5B is a side view of the base of the furniture system forming the table in the fourth configuration.
Figure 5A:
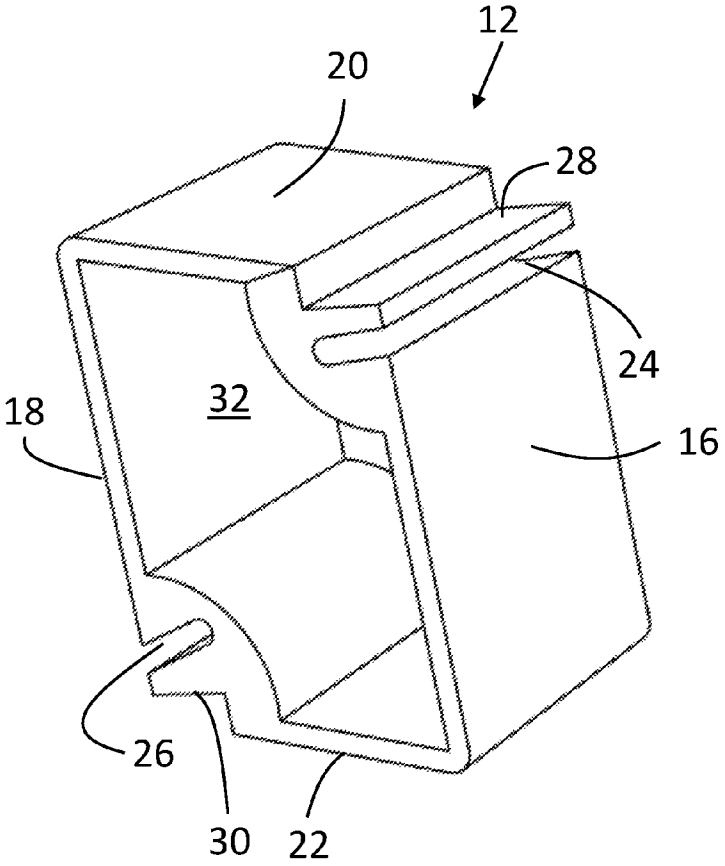
FIG. 5A is perspective view of a base of the furniture system forming a table in a fourth configuration.

FIG. 5A is perspective view of the base 12 of the furniture system 10 forming a table in a fourth configuration. FIG. 5B is a side view of the base 12 of the furniture system 10 forming the table in the fourth configuration. In the fourth configuration, the base 12 can be rotated (as compared to the third configuration) such that the surface 22 is on the bottom adjacent a floor and the surface 20 forms a table top. The base 12 can also be rotated such that the surface 20 is on the bottom adjacent the floor and the surface 22 forms the table top. In either orientation, the base 12 can be used as a table without using the top 14 (omitted from FIGS. 5A and 5B).

When the base 12 is oriented as shown in FIG. 5B, the base 12 can present multiple surfaces for supporting objects. For example, the surface 20 can function as a main table top and a surface 44 of the indentation 28 can function as a ledge, both capable of supporting objects at or near a top of the base 12. The surface 20 can be substantially horizontal and the surface 44 of the indentation 28 can be slightly angled with respect to horizontal. The size, shape, and orientation of the surfaces 20 and 44 can facilitate holding different objects. For example, the surface 20 can support larger objects (such as a lamp or larger electronic devices) and the surface 44 can support smaller objects (such as pens, pencils, and smaller electronic devices). Additionally, a surface for supporting objects is located near to the floor at the inner surface 32 of the base 12.

In some embodiments, the base 12 can be at least partially elongated, with the surfaces 16 and 18 being longer than the surfaces 20 and 22. This can allow the base 12 to be used as a table that has different heights depending on its orientation. For example, the furniture system 10 forming a table in the third configuration (see FIGS. 3, 4A, and 4B) can be shorter than the furniture system 10 forming a table in the third configuration (see FIGS. 5A and 5B). In some embodiments, the furniture system 10 can be used as a coffee table in the third configuration and as an end table in the fourth configuration. In other embodiments, the furniture system 10 can be used as a table for different applications.

Figure 6B:
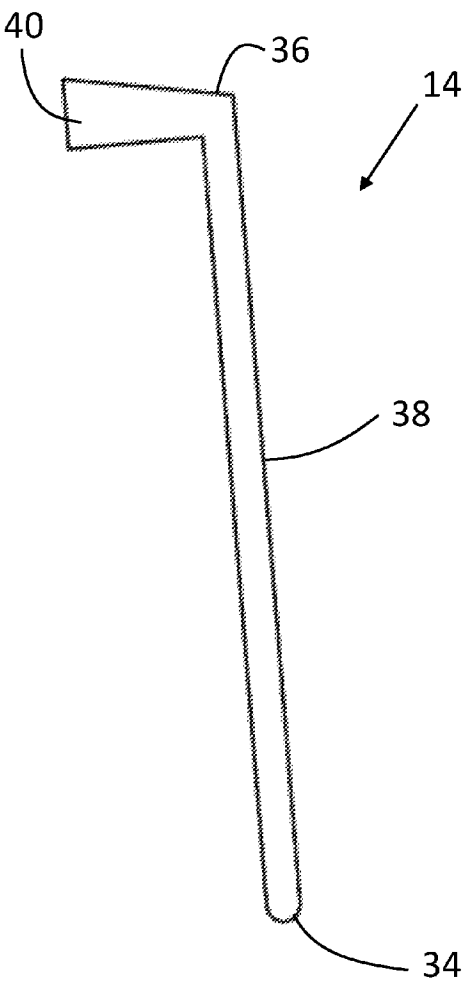
FIG. 6B is a side view of the top of the furniture system.
Figure 6A:
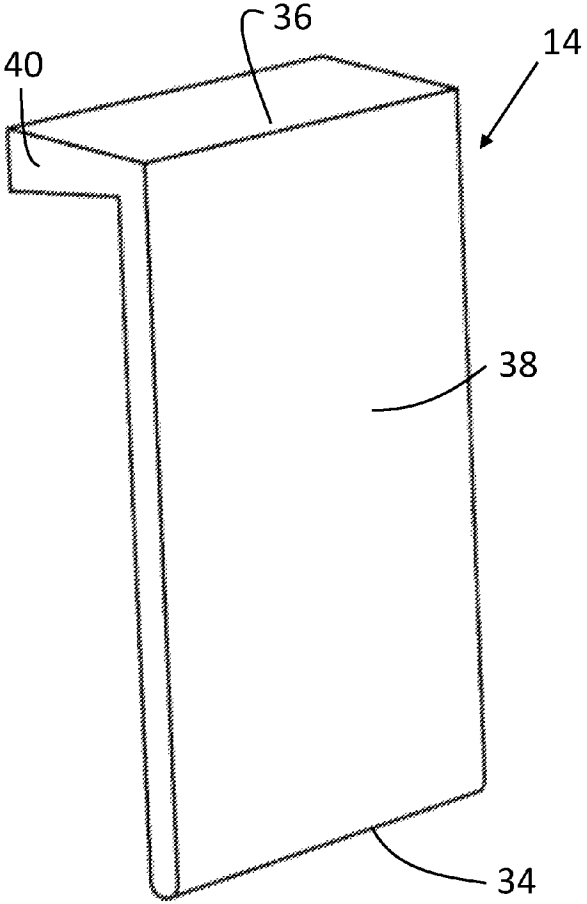
FIG. 6A is a perspective view of a top of the furniture system.

FIG. 6A is a perspective view of the top 14 of the furniture system 10. FIG. 6B is a side view of the top 14 of the furniture system 10. FIGS. 6A and 6B help show the shape and configuration of the top 14 in at least some embodiments. In other embodiments, the shape and features of the top 14 can be varied as suitable for the application.

Figure 7B:
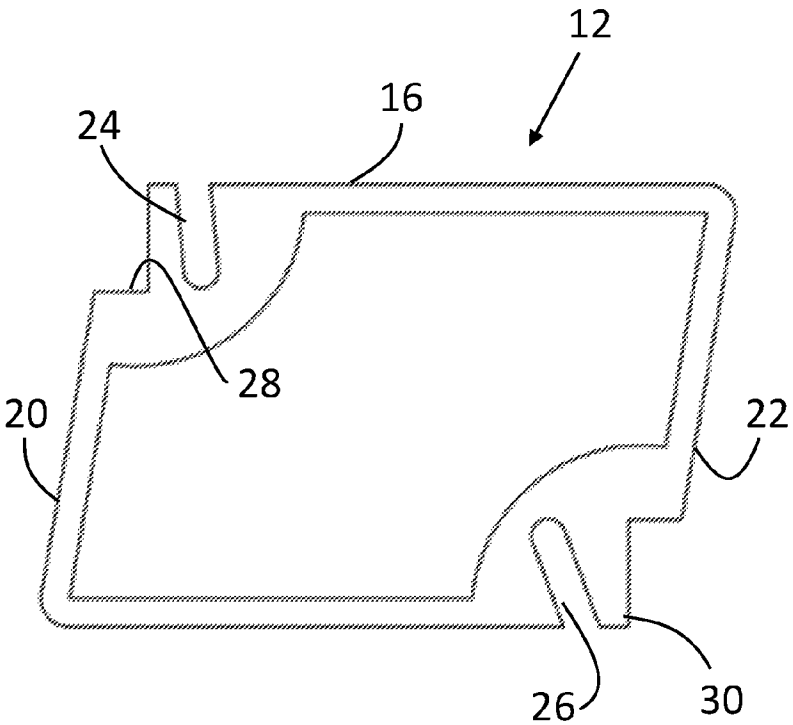
FIG. 7B is a side view of the base of the furniture system.
Figure 7A:
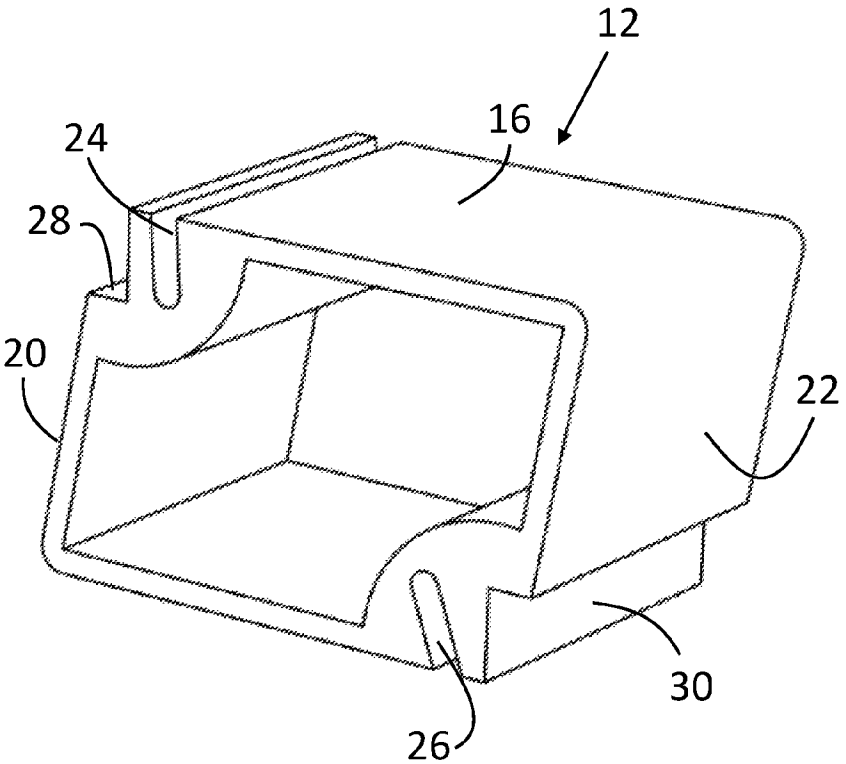
FIG. 7A is a perspective view of the base of the furniture system.

FIG. 7A is a perspective view of the base 12 of the furniture system 10. FIG. 7B is a side view of the base 12 of the furniture system 10. FIGS. 7A and 7B help show the shape and configuration of the base 12 in at least some embodiments. In other embodiments, the shape and features of the base 12 can be varied as suitable for the application.

Figure 8B:
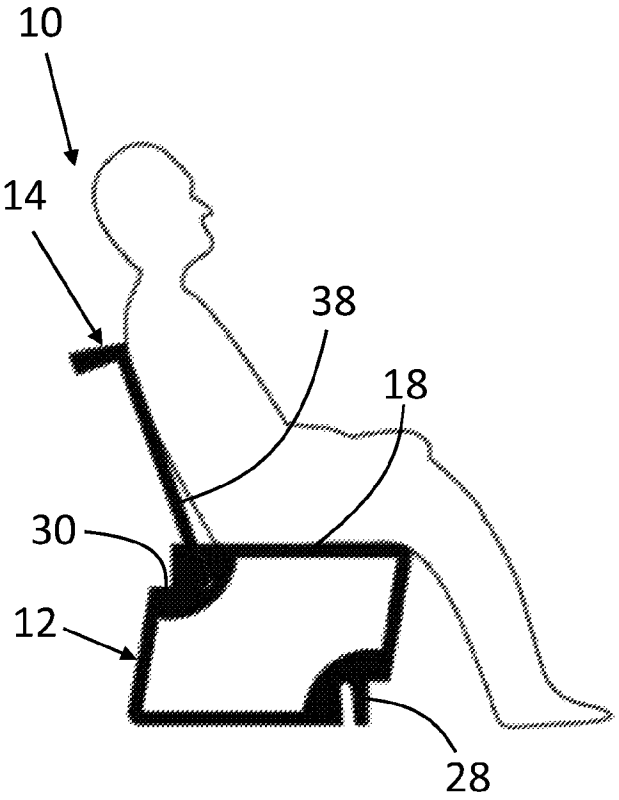
FIG. 8B is a side view of a user sitting on the furniture system forming the chair in the second configuration.
Figure 8A:
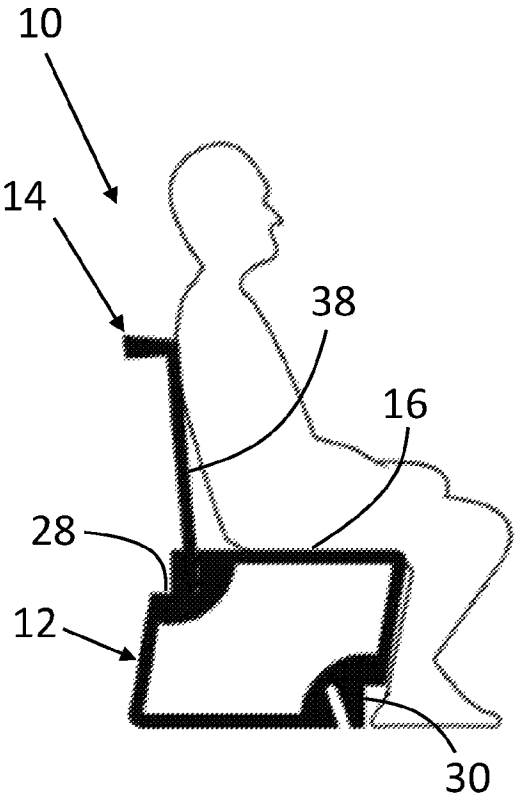
FIG. 8A is a side view of a user sitting on the furniture system forming the chair in the first configuration.

FIG. 8A is a side view of a user sitting on the furniture system 10 forming the chair in the first configuration. In the first configuration, the user can sit on the surface 16 of the base 12, with the user's back resting against the platform 38 of the top 14. The user's heels can be positioned near or in the indentation 30 when sitting substantially upright.

FIG. 8B is a side view of a user sitting on the furniture system 10 forming the chair in the second configuration. In the second configuration, the user can sit on the surface 18 of the base 12, with the user's back resting against the platform 38 of the top 14. The top 14 and the platform 38 can be reclined at a greater angle than in the first configuration, allowing the user to also recline more when the user's back is against the platform 38. The user's heels can be positioned near or in the indentation 28, or can be extended outward as shown in FIG. 8B.

Figure 9:
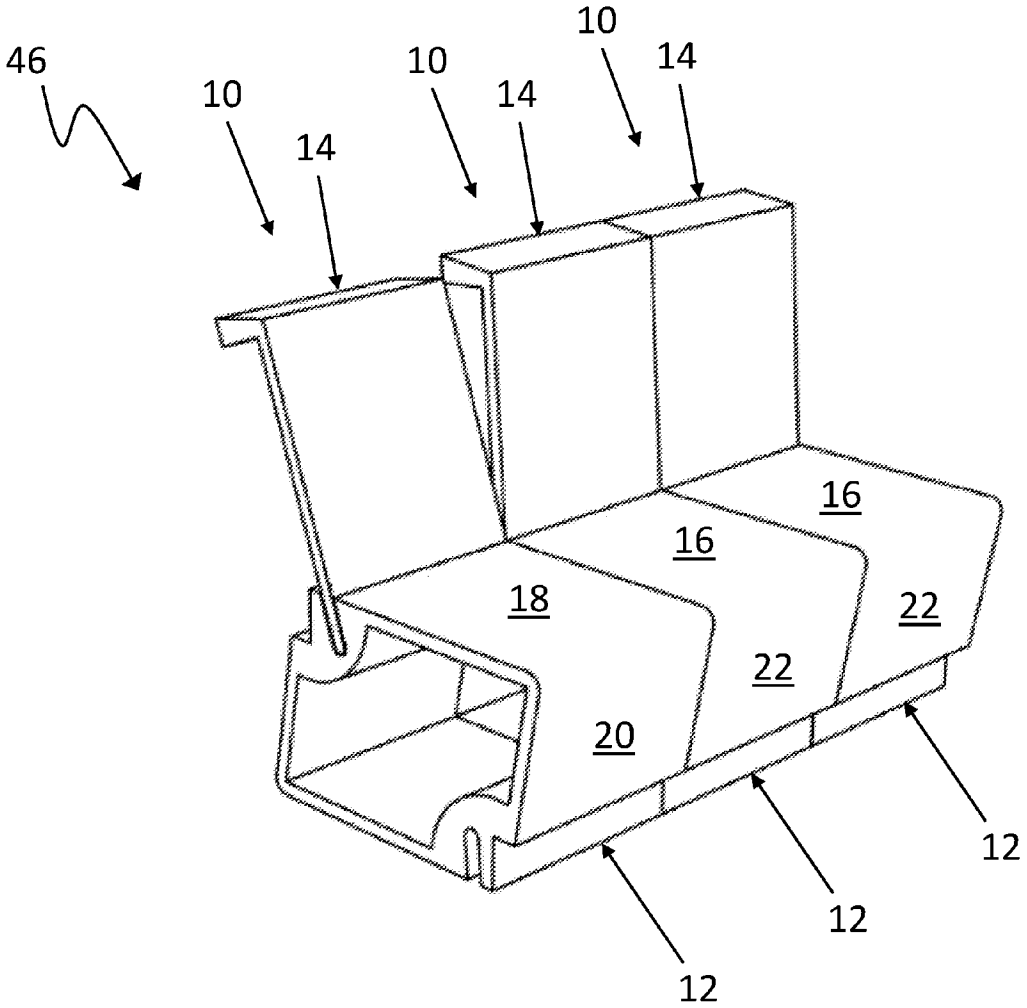
FIG. 9 is a perspective view of multiple furniture systems combined to form a bench.

FIG. 9 is a perspective view of multiple furniture systems 10 combined to form a bench 46. The furniture systems 10 are set side-by-side, adjacent to one another. One or more of the furniture systems 10 can be oriented as a chair in the first configuration and one or more of the furniture systems 10 can be oriented as a chair in the second configuration. Accordingly, the furniture systems 10 can be oriented as chairs in different configurations and still combine to form a common bench 46. Alternatively, the bench 46 can include furniture systems 10 all oriented in the same configuration.

Figure 10:
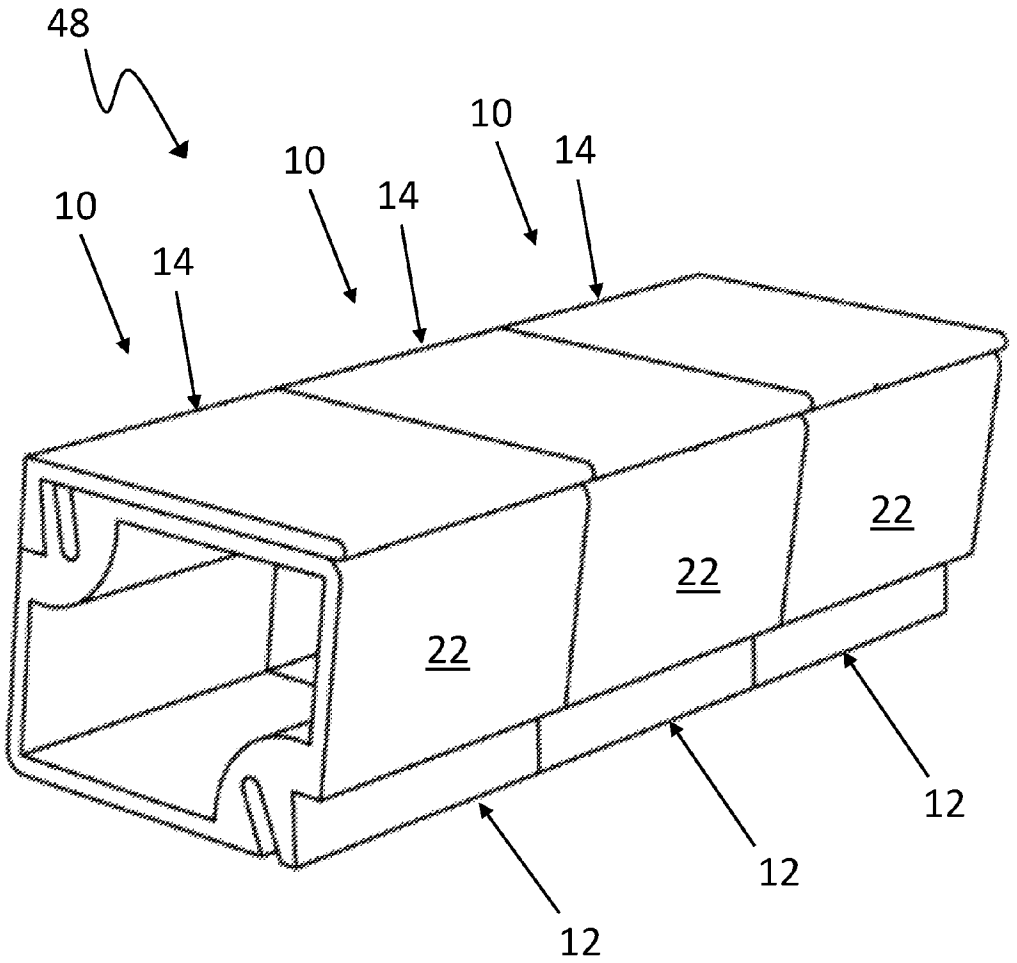
FIG. 10 is a perspective view of multiple furniture systems combined to form an elongated table.

FIG. 10 is a perspective view of multiple furniture systems 10 combined to form an elongated table 48. The furniture systems 10 are set side-by-side, adjacent to one another. The table 48 can include furniture systems 10 all oriented in the same configuration. Alternatively, the furniture systems 10 can be oriented in different configurations, such as one or more furniture systems 10 oriented as chairs and one or more furniture systems 10 oriented as tables.

Figure 11:
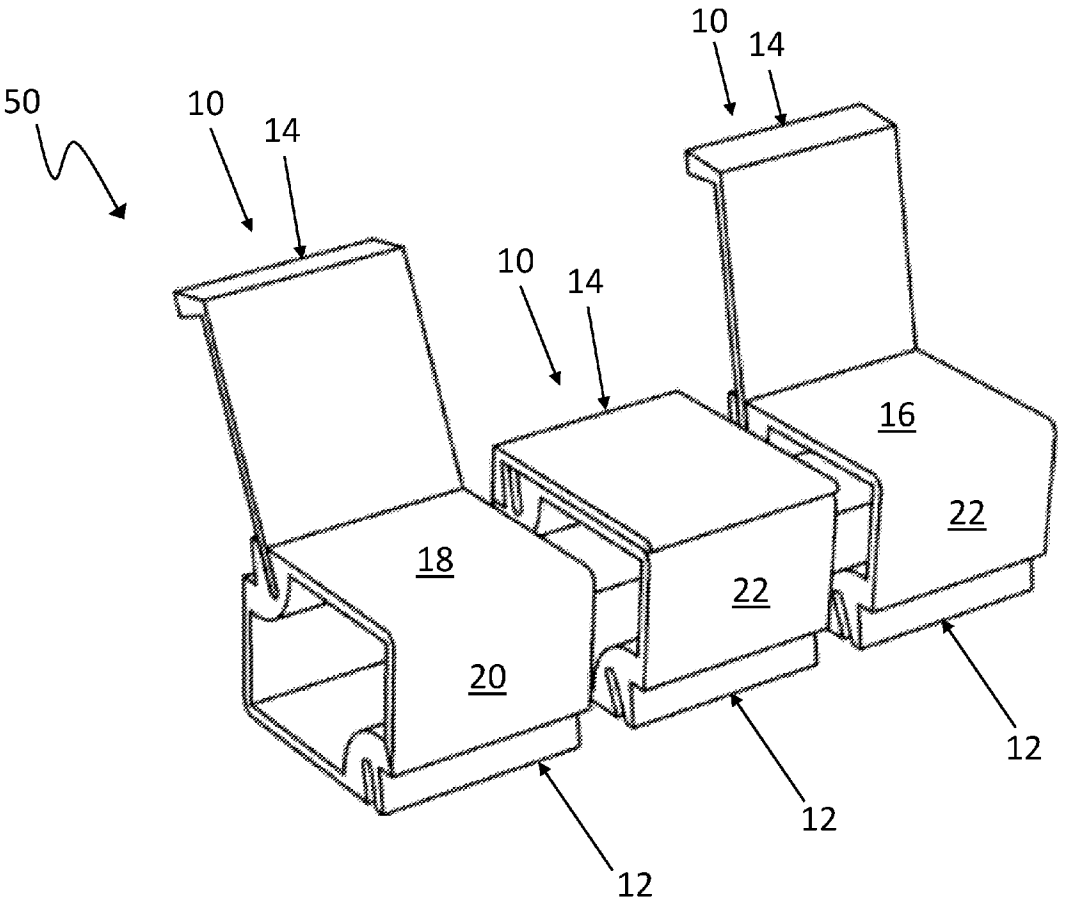
FIG. 11 is a perspective view of multiple furniture systems combined to form an arrangement with chairs and a table.

FIG. 11 is a perspective view of multiple furniture systems 10 combined to form an arrangement 50 with chairs and a table. The furniture systems 10 can be oriented as one chair in the first configuration, one chair in the second configuration, and one table in the third configuration between the furniture systems 10 oriented as chairs. Alternatively, the furniture systems 10 can be oriented in different configurations as suitable for the application.

Figure 12:
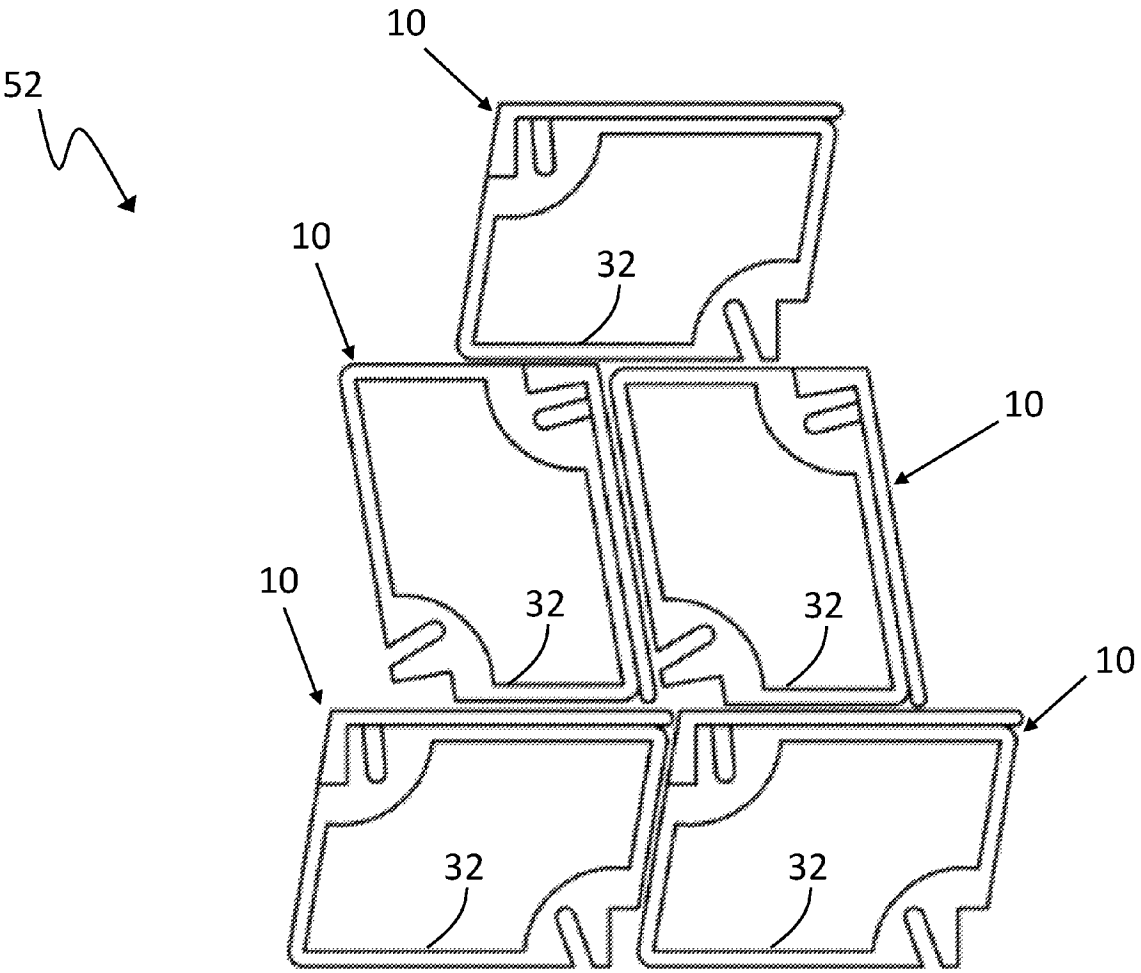
FIG. 12 is a side view of multiple furniture systems combined to form a shelving system.

FIG. 12 is a side view of multiple furniture systems 10 combined to form a shelving system 52. The furniture systems 10 can be stacked so as to allow access to the passageway defined by the inner surface 32 of the base 12. In some embodiments, the furniture systems 10 can be stacked in a common orientation. For example, the furniture systems 10 can be positioned in the third configuration as a table, and stacked to form the shelving system 52. Alternatively, the furniture systems 10 can be positioned in the fourth configuration as a table, and stacked to form the shelving system 52. Alternatively, the furniture systems 10 can be positioned in different orientations and stacked to form the shelving system 52 (such as shown in FIG. 12).

In various embodiments, the furniture system 10 can be manufactured from wood, polymer, or another material suitable for the application. In some embodiments, the furniture system 10 can be made from layers of laminated wooded rings. For example, a flat sheet of wooden material can first be machined via a router to form a shape that when viewed from the side is the same or similar to that of the base 12 when viewed from the side as in FIG. 7B. Material can be removed from the interior to form a ring and from the exterior perimeter to form a portion of each of the slots 24 and 26 and the indentations 28 and 30. These steps can then be repeated on additional sheets of wooden material to form additional rings that are the same or similar to that of the base 12 when viewed from the side as in FIG. 7B.

The machined rings can then be laminated and adhered to each other in series. The number of rings can be selected to achieve a suitable width for the base 12. Because each ring can be relatively thin (e.g. about one inch or less), several rings may be needed to achieve a suitable width. After the rings have been adhered to form the general shape of the base 12, the material can then be finished, which can include sanding, polishing, sealing, and/or staining.

The top 14 can be formed from a similar procedure. For example, a flat sheet of wooden material can first be machined via a router to form a shape that when viewed from the side is the same or similar to that of the top 14 when viewed from the side as in FIG. 6B. Material can be removed from the perimeter to form a portion of each of the platform 38 and the extension 40. These steps can then be repeated on additional sheets of wooden material to form additional pieces that are the same or similar to that of the top 14 when viewed from the side as in FIG. 6B. The machined pieces can then be laminated and adhered to each other in series. The number of pieces can be selected to achieve a suitable width for the top 14. Because each piece can be relatively thin (e.g. about one inch or less), several pieces may be needed to achieve a suitable width. In some embodiments, the number of pieces to form the top 14 can be the same as the number of rings to form the base 12. After the pieces have been adhered to form the general shape of the top 14, the material can then be finished, which can include sanding, polishing, sealing, and/or staining.

In other embodiments, one or more additional and/or different procedures can be used to manufacture the base 12 and/or the top 14. In some of such embodiments, the base 12 can be manufactured using a procedure different than the top 14.

Therefore, the furniture system 10 can have multiple variations as chairs and tables. By using the top 14 as a seat back and slipping it into the appropriately angled slot (slot 24 or 26), a user has the option to sit more upright (e.g. about 95 degrees) where a heel space formed by one of the indentations 28 and 30 is provided, or to sit more reclined and relaxed (e.g. about 110 degrees). To achieve the second angle, the user can turn the base 12 180 degrees from the position shown in FIG. 1A to the position shown in FIG. 1B.

The furniture system 10 can also be used as a table that provides a tabletop (such as formed by the platform 38 as shown in FIG. 3) and storage area (such as defined by the inner surface 32 of the base 12). Due to the indentations 28 and 30 being symmetrical on both sides of the base 12, furniture system 10 can be used to form a table whether the slot 24 or the slot 26 is positioned on top, extending substantially upright. The furniture item 10 can also be used as a table with the top 14 removed and the base 12 rotated 90 degrees, with a larger and higher tabletop that can be used along with a smaller and lower angled tabletop. Various possibilities of combinations can be formed by using more than one furniture system 10, such as a bench (such as the bench 46), an elongated coffee table (e.g. the elongated table 48), and/or a shelving unit (such as the shelving system 52). The user can determine which configuration is most suitable at a given time based on needs of the user. Therefore, the furniture system 10 can in some embodiments include only two pieces (the base 12 and the top 14) and yet form a variety of configurations with a variety of functions.

A number of embodiments of the invention have been described. Nevertheless, it will be understood that various modifications may be made without departing from the spirit and scope of the invention. For example, the base and top need not be shaped precisely as illustrated, but rather can have different curves, angles, and thicknesses. In addition, the furniture system can include additional (or fewer) features or components than those described herein. Accordingly, other embodiments are within the scope of the following claims.

What is claimed is:

1. A furniture system comprising:

a base having a first surface defining a first slot and a second surface defining a second slot, wherein the first surface is substantially parallel to the second surface; and a top having an end sized and configured to be inserted in the first slot and in the second slot, wherein the furniture system forms a chair of a first configuration with the top forming a chair back and the first surface forming a first chair seat when the end of the top is inserted in the first slot and wherein the furniture system forms a chair of a second configuration with the top forming the chair back and the second surface forming a second chair seat when the end of the top is inserted in the second slot.

2. The furniture system of claim 1, wherein the first slot has a first angle and the second slot has a second angle different than the first angle such that the chair back is reclined at a greater angle in the second configuration than in the first configuration.

3. The furniture system of claim 1, wherein a third surface extends from the first surface to the second surface and is angled with respect to the first surface at an obtuse angle and with respect to the second surface at an acute angle, wherein a fourth surface extends from the first surface to the second surface and is angled with respect to the first surface at an acute angle and with respect to the second surface at an obtuse angle, and wherein the third surface is substantially parallel to the fourth surface.

4. The furniture system of claim 3, wherein the first slot is positioned nearer the third surface than the fourth surface, wherein the first slot is angled with respect to both the first and third surfaces at acute angles, wherein the second slot is positioned nearer the fourth surface than the third surface, and wherein the second slot is angled with respect to both the second and fourth surfaces at acute angles.

5. The furniture system of claim 1, wherein the base has a substantially parallelepiped outer shape and is substantially tubular so as to define a passage through the base, wherein the passage is defined between the first surface, the second surface, a third surface, and a fourth surface.

6. A furniture system comprising:

a base having a first surface defining a first slot and a second surface defining a second slot; and a top having an end sized and configured to be inserted in the first slot and in the second slot, wherein the furniture system forms a chair of a first configuration with the top forming a chair back and the first surface forming a first chair seat when the end of the top is inserted in the first slot and wherein the furniture system forms a chair of a second configuration with the top forming the chair back and the second surface forming a second chair seat when the end of the top is inserted in the second slot, wherein the base defines a first indentation positioned along a first corner of the base and a second indentation positioned along a second corner of the base opposite the first corner.

7. The furniture system of claim 6, wherein the top comprises an extension sized to fit in and substantially fill each of the first and second indentations.

8. The furniture system of claim 7, wherein the end is a first end, wherein the top comprises a second end, and wherein the extension extends from the second end with a substantially trapezoidal cross section.

9. The furniture system of claim 7, wherein the furniture system forms a table of a third configuration with the top forming a table top when the top is positioned on the base with the extension positioned in one of the first and second indentations.

10. The furniture system of claim 6, wherein the second indentation is sized and positioned to receive at least part of a user's heel when the furniture system forms the chair of the first configuration, and wherein the first indentation is sized and positioned to receive at least part of the user's heel when the furniture system forms the chair of the second configuration.

11. The furniture system of claim 6, wherein the first indentation is positioned proximate the first slot and the second indentation is positioned proximate the second slot.

12. A furniture system comprising:

a base having a first surface defining a first slot and a second surface defining a second slot; and a top having an end sized and configured to be inserted in the first slot and in the second slot, wherein the furniture system forms a chair of a first configuration with the top forming a chair back and the first surface forming a first chair seat when the end of the top is inserted in the first slot and wherein the furniture system forms a chair of a second configuration with the top forming the chair back and the second surface forming a second chair seat when the end of the top is inserted in the second slot, wherein the furniture system forms a table of a third configuration with the top forming a first table top when the top is positioned on the base with the end not inserted in either of the first and second slots.

13. The furniture system of claim 12, wherein the first surface is substantially parallel to the second surface and the base defines a first indentation positioned along a first corner of the base and a second indentation positioned along a second corner of the base opposite the first corner.

14. The furniture system of claim 12, wherein the furniture system forms a table of a fourth configuration when the base is rotated such that the first and second surfaces are side surfaces and the top is removed from the base.

15. The furniture system of claim 14, wherein the base defines second and third table tops when forming the table of the fourth configuration, wherein a first indentation is positioned along a first corner of the base and a second indentation positioned along a second corner of the base opposite the first corner, and wherein the third table top is positioned along a surface of the first indentation.

16. An elongated table comprising a plurality of the furniture systems of claim 12 positioned adjacent to one another, wherein each of the furniture systems is in the third configuration.

17. A bench comprising a plurality of the furniture systems of claim 1 set adjacent to one another with one or more of the furniture systems oriented as the chair of the first configuration and one or more of the furniture systems oriented as the chair of the second configuration.

18. A shelving system comprising a plurality of the furniture systems of claim 1 stacked so as to allow access to passageways defined by inner surfaces of the bases of the furniture systems.

19. A method of assembling the furniture system of claim 1, the method comprising:

positioning the base on a floor with the second surface adjacent the floor;

inserting the end of the top into the first slot to form the chair of the first configuration;

removing the end of the top from the first slot;

rotating the base 180 degrees and positioning the base on the floor with the first surface adjacent the floor;

inserting the end of the top into the second slot to form the chair of the second configuration; and removing the end of the top from the second slot.

20. The method of claim 19, and further comprising:

positioning the top on the base with the end of the top not inserted in either of the first and second slots to form a table in a third configuration.

* * * * *